US011293205B2

(12) United States Patent
Shiratori

(10) Patent No.: US 11,293,205 B2
(45) Date of Patent: Apr. 5, 2022

(54) VEHICLE DOOR LOCK DEVICE

(71) Applicant: TOYOTA JIDOSHA KABUSHIKI KAISHA, Toyota (JP)

(72) Inventor: Koji Shiratori, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 556 days.

(21) Appl. No.: 16/259,557

(22) Filed: Jan. 28, 2019

(65) Prior Publication Data

US 2019/0301211 A1 Oct. 3, 2019

(30) Foreign Application Priority Data

Mar. 28, 2018 (JP) ..... JP2018-063027

(51) Int. Cl.

*E05B 81/14* (2014.01)
*E05B 81/06* (2014.01)
*E05B 81/16* (2014.01)
*E05B 81/36* (2014.01)

(52) U.S. Cl.

CPC ..... *E05B 81/14* (2013.01); *E05B 81/06* (2013.01); *E05B 81/16* (2013.01); *E05B 81/36* (2013.01)

(58) Field of Classification Search

CPC ..... E05B 81/06; E05B 81/12; E05B 81/14; E05B 81/16; E05B 81/32; E05B 81/34; E05B 81/36; E05B 2047/0084; E05B 2047/0085; E05B 2047/0086; Y10T 292/1047; Y10T 292/1082; Y10S 292/23

See application file for complete search history.

(56) References Cited

U.S. PATENT DOCUMENTS 8,474,888 B2 * 7/2013 Tomaszewski ..... E05B 77/30 292/201
2001/0005079 A1 * 6/2001 Takamura ..... E05B 81/20 292/201
2002/0140237 A1 10/2002 Kobayashi et al.
2006/0186675 A1 * 8/2006 Suzumura ..... E05B 77/26 292/216

(Continued)

FOREIGN PATENT DOCUMENTS

CN 203476012 U 3/2014
EP 0784140 A1 * 7/1997 ..... E05B 81/06

(Continued)

*Primary Examiner* — Christine M Mills
*Assistant Examiner* — Christopher F Callahan
(74) *Attorney, Agent, or Firm* — Oliff PLC

(57) ABSTRACT

A vehicle door lock device, including: a latch unit provided at a vehicle door, selectively adopting an unlatched state in which the vehicle door can be opened, or a latched state in which the vehicle door is maintained in a closed state, and transitioning from the unlatched state to the latched state in a case, in the unlatched state, in which the vehicle door is closed relative to the vehicle body; a mechanical operation unit switching the latch unit from the latched state to the unlatched state by means of at least one of operative parts being operated; an electrical operation unit connected to the mechanical operation unit, and switching the latch unit to the latched state or to the unlatched state, by means of power from a drive unit; and a cancellation unit that releases the connection between the electrical operation unit and the mechanical operation unit.

3 Claims, 13 Drawing Sheets

(56) References Cited

U.S. PATENT DOCUMENTS

| | | | | |
|---|---|---|---|---|
| 2010/0026014 | A1* | 2/2010 | Machida | E05B 81/20 292/216 |
| 2014/0000169 | A1* | 1/2014 | Yokomori | E05B 81/06 49/349 |
| 2014/0001771 | A1 | 1/2014 | Shibayama et al. | |
| 2014/0070549 | A1 | 3/2014 | Hanaki et al. | |
| 2015/0329009 | A1 | 11/2015 | Dente | |
| 2015/0330111 | A1 | 11/2015 | Dente et al. | |
| 2015/0330116 | A1 | 11/2015 | Dente | |
| 2016/0312498 | A1 | 10/2016 | Jidaisho | |

FOREIGN PATENT DOCUMENTS

| | | | | |
|---|---|---|---|---|
| JP | 2002-295096 | A | 10/2002 | |
| JP | 2004-250899 | A | 9/2004 | |
| JP | 2014-009588 | A | 1/2014 | |
| JP | 2014-074324 | A | 4/2014 | |
| JP | 2016-503135 | A | 2/2016 | |
| JP | 2016-205000 | A | 12/2016 | |
| WO | WO-2011077799 | A1 * | 6/2011 | E05B 85/02 |
| WO | WO-2013170363 | A1 * | 11/2013 | E05B 81/06 |

* cited by examiner

VEHICLE DOOR LOCK DEVICE

CROSS-REFERENCE TO RELATED APPLICATION

This application claims priority under 35 USC 119 from Japanese Patent Application No. 2018-063027 filed Mar. 28, 2018, the disclosure of which is incorporated by reference herein in its entirety.

BACKGROUND

Technical Field

The present disclosure relates to a vehicle door lock device.

Related Art

Japanese Patent Application Laid-open (JP-A) No. 2002-295096 discloses a vehicle door latch operation device. This vehicle door latch operation device is provided at a vehicle door that is freely openable and closeable relative to the vehicle body, and in addition, is provided with: a latch unit that can effect an unlatched state that puts the vehicle door in an open state relative to the vehicle body and a latched state that puts the vehicle door in a closed state relative to the vehicle body; an electrical drive unit that can actuate the latch unit into either one of the latched state or the unlatched state; and a mechanical operation member that can actuate the latch unit from the latched state to the unlatched state. This electrical drive unit is provided with a motor and actuates the latch unit by means of the drive force of the motor. As a result of this, the operative force required when a vehicle occupant operates the latch unit can be reduced. Further, the mechanical operation member is configured by plural link members, and a vehicle occupant can actuate the latch unit from the latched state to the unlatched state by operating these link members.

Accordingly, even in a case in which the electrical drive unit has malfunctioned, it is possible, by operating the mechanical operation member, to avoid a situation in which a vehicle occupant becomes trapped inside the vehicle cabin.

SUMMARY

However, in the case of the configuration disclosed in JP-A No. 2002-295096, in a case in which the electrical drive unit has malfunctioned in a state in which the latch unit has been actuated from the latched state to the unlatched state, there is a possibility that the latch unit will be retained in an open state. In such a case, it may not be possible to put the vehicle door into a closed state, and there is a possibility that the vehicle cannot be made to travel. Accordingly, there is room for improvement of the above-described conventional technique as regards this point.

In consideration of the foregoing circumstances, an object of the preferred embodiments is to provide a vehicle door lock device that can put a vehicle door into a latched state from an unlatched state even at a time of malfunction.

A vehicle door lock device according to a first aspect of the present disclosure includes a latch unit, a mechanical operation unit, an electrical operation unit and a cancellation unit. The latch unit is provided at a vehicle door, selectively adopts an unlatched state in which the vehicle door can be opened relative to a vehicle body, or a latched state in which the vehicle door is maintained in a closed state relative to the vehicle body. The latch unit transitions from the unlatched state to the latched state in a case, in the unlatched state, in which the vehicle door is closed relative to the vehicle body. The mechanical operation unit includes plural operative parts, switches the latch unit from the latched state to the unlatched state by means of at least one of the operative parts being operated. The electrical operation unit is connected to the mechanical operation unit, is provided with a drive unit, and switches the latch unit to the latched state or to the unlatched state, by means of power from the drive unit. The cancellation unit releases the connection between the electrical operation unit and the mechanical operation unit.

The vehicle door lock device of the first aspect has a latch unit, a mechanical operation unit and an electrical operation unit. The latch unit is provided at the vehicle door and, in addition, selectively adopts an unlatched state in which the vehicle door can be opened relative to a vehicle body, or a latched state in which the vehicle door is maintained in a closed state relative to the vehicle body. This latch unit transitions from the unlatched state to the latched state in a case, in the unlatched state, in which the vehicle door is closed relative to the vehicle body. That is, when the vehicle door in an open state is closed, a closed state is maintained. Further, the mechanical operation unit is provided with plural operative parts and switches the latch unit from the latched state to the unlatched state by means of at least one of the operative parts being operated. Further, the electrical operation unit is connected to the mechanical operation unit and, in addition, is provided with a drive unit and switches the latch unit to the latched state or to the unlatched state, by means of power from the drive unit. Accordingly, the operative force required when a vehicle occupant puts the vehicle door into an open state or a closed state can be reduced by the electrical operation unit.

Here, the vehicle door lock device has a cancellation unit, and this cancellation unit can release the connection between the electrical operation unit and the mechanical operation unit. Accordingly, in a case in which the electrical operation unit has malfunctioned, it is possible to prevent the latch unit from remaining in an unlatched state as a result of the malfunction of the electrical operation unit, by having the connection between the electrical operation unit and the mechanical operation unit released by the cancellation unit. As a result of this, the latch unit, which has been disconnected from the electrical operation unit, transitions from the unlatched state to the latched state when the vehicle door is closed. That is, the vehicle door can be maintained in a closed state even in a case in which the electrical operation unit has malfunctioned.

In a vehicle door lock device of a second aspect of the present disclosure, the cancellation unit of the first aspect is configured to be operable by at least one of the plural operative parts.

According to the vehicle door lock device of the second aspect, the cancellation unit is configured to be operable by at least one of the plural operative parts. That is, since the operative parts that operate the mechanical operation unit can also be used in the operation of the cancellation unit, the number of component parts can be reduced.

In a vehicle door lock device of a third aspect of the present disclosure, the latch unit of the first aspect or the second aspect includes a release part that selectively adopts an engaged state of engagement with a latch, or a non-engaged state of non-engagement with the latch, the latch unit being in the latched state in the engaged state and the latch unit being in the unlatched state in the non-engaged state, and the electrical operation unit includes a wheel gear that is engaged with the drive unit and configured rotatably, and a lever member that is engaged with the wheel gear and that switches the release part between the engaged state and the non-engaged state by being displaced in conjunction with the rotation of the wheel gear.

According to the vehicle door lock device of the third aspect, the latch unit has a release part. This release part selectively adopts an engaged state of engagement with a latch, or a non-engaged state of non-engagement with the latch, the latch unit being in the latched state in the engaged state and the latch unit being in the unlatched state in the non-engaged state. Further, the electrical operation unit includes a wheel gear and a lever member. The wheel gear is engaged with the drive unit and configured rotatably. The lever member is engaged with the wheel gear and switches the release part between the engaged state and the non-engaged state by being displaced in conjunction with the rotation of the wheel gear. Accordingly, it is possible to switch the latch unit between the latched state and the unlatched state by activating the drive unit. That is, owing to the above-described simple configuration, operation of the latch unit can be performed by using drive force from the drive unit.

In a vehicle door lock device of a fourth aspect of the present disclosure, the cancellation unit of the third aspect includes a cancellation lever that is engaged with the wheel gear and at which a cancellation side engagement hole part is formed, a release lever that switches the release part between the engaged state and the non-engaged state, and at which a release side engagement hole part is formed at a position corresponding to the cancellation side engagement hole part of the cancellation lever, and a cancellation pin that is inserted so as to engage with each of the cancellation side engagement hole part and the release side engagement hole part and that connects the cancellation lever with the release lever. The cancellation unit is disposed with a disengagement part that releases the cancellation pin from engagement with at least one of the cancellation side engagement hole part or the release side engagement hole part, and that releases the connection between the cancellation lever and the release lever.

According to the vehicle door lock device of the fourth aspect, the cancellation unit includes a cancellation lever that is engaged with the wheel gear, a release lever that switches the state of the release part and at which a release side engagement hole part is formed at a position corresponding to a cancellation side engagement hole part of the cancellation lever, and a cancellation pin. The cancellation pin is inserted so as to engage with each of the cancellation side engagement hole part and the release side engagement hole part. Accordingly, since the cancellation lever and the release lever are, so to speak, connected by the cancellation pin, it is possible to switch the release part between an engaged state and a non-engaged state by displacement of the cancellation lever and the release lever in conjunction with the rotation of the wheel gear. That is, operation of the latch unit can be performed by using drive force from the drive unit.

Here, the cancellation unit is disposed with a disengagement part, and this disengagement part releases the cancellation pin from engagement with at least one of the cancellation side engagement hole part or the release side engagement hole part. As a result of this, since the cancellation lever and the release lever become capable of movement relative to each other as a result of the connection between the cancellation lever and the release lever having been released, even if the drive unit malfunctions, it is possible to switch the latch unit between the latched state and the unlatched state by moving the release lever and switching the release part between the engaged state and the non-engaged state. That is, owing to the above-described simple configuration, it is possible to release the latch unit from being retained in a closed state or an open state.

In a vehicle door lock device of a fifth aspect of the present disclosure, the mechanical operation unit of the fourth aspect includes an active lever that switches between a locked state that restricts transition of the release part from the engaged state to the non-engaged state, and an unlocked state that permits transition of the release part from the engaged state to the non-engaged state, by means of operation of at least one of the plural operative parts. Further, the disengagement part is provided at the active lever.

According to the vehicle door lock device of the fifth aspect, the disengagement part of the cancellation unit is provided at an active lever. This active lever configures one part of the mechanical operation unit, and switches between a locked state that restricts transition of the release part from the engaged state to the non-engaged state, and an unlocked state that permits transition of the release part from the engaged state to the non-engaged state, by means of operation of at least one of the plural operative parts. That is, the operative parts that operate the mechanical operation unit can also be used in the operation of the cancellation unit. Accordingly, the number of component parts can be reduced.

In a vehicle door lock device of a sixth aspect of the present disclosure, the active lever of the fifth aspect moves in conjunction with at least one of a key lever provided at a vehicle width direction outer side of the vehicle door or an inside lever provided at a vehicle width direction inner side of the vehicle door. The disengagement part of the active lever is configured to be operable such that the cancellation pin moves away from at least one of the cancellation side engagement hole part or the release side engagement hole part by means of operation of the key lever or the inside lever.

According to the vehicle door lock device of the sixth aspect, the active lever moves in conjunction with at least one of a key lever provided at a vehicle width direction outer side of the vehicle door or an inside lever provided at a vehicle width direction inner side of the vehicle door. Further, the disengagement part of the active lever is configured to be operable by means of operation of the key lever or the inside lever. Accordingly, a vehicle occupant can also operate the cancellation unit by means of a conventional vehicle door opening/closing operation. That is, operation of the cancellation unit can be performed easily.

In a vehicle door lock device of a seventh aspect of the present disclosure, in any one of the fourth to sixth aspects, a connection part, which connects the release side engagement hole part with a vehicle front side of a through-hole formed at the release lever, is formed at a part of an outer edge part of the release side engagement hole part, and the cancellation side engagement hole part engages with the cancellation pin at a position corresponding to the connection part.

According to the vehicle door lock device of the seventh aspect, a connection part, which connects the release side engagement hole part with a vehicle front side of a through-hole formed at the release lever, is formed at a part of an outer edge part of the release side engagement hole part. Accordingly, the cancellation pin, having been inserted inside the release side engagement hole part, can be released from engagement with the release side engagement hole part by moving toward the vehicle front side of the through-hole via the connection part. Further, since the cancellation side engagement hole part engages with the cancellation pin at a position corresponding to the connection part, the cancellation pin engages with the cancellation side engagement hole part even in a state in which the cancellation pin has been released from engagement with the release side engagement hole part. Accordingly, since this is a state in which the cancellation pin remains at the cancellation side engagement hole part, the operation of once more inserting the cancellation pin into the release side engagement hole part after the cancellation unit has been activated, is facilitated.

The vehicle door lock device of the first aspect has the superior effect whereby the vehicle door can be put into a closed state from an open state even at a time of malfunction.

The vehicle door lock device of the second to fifth aspects has the superior effect whereby costs can be reduced.

The vehicle door lock device of the sixth aspect has the superior effect whereby operability can be improved.

The vehicle door lock device of the seventh aspect has the superior effect whereby ease of maintenance can be improved.

BRIEF DESCRIPTION OF THE DRAWINGS

Exemplary embodiments of the present invention will be described in detail based on the following figures, in which.

DETAILED DESCRIPTION

First Exemplary Embodiment

In the following, vehicle door lock device 10 according to a first exemplary embodiment of the present disclosure is explained based on FIGS. 1 to 9. It should be noted that arrow FR, arrow UP and arrow OUT, which are shown as appropriate in the respective drawings, indicate a vehicle forward direction (direction of forward travel), an upward direction, and an outer side in a vehicle width direction, respectively. In the following, in the case of explanation using simply front-rear, left-right, and vertical directions, unless otherwise indicated, these indicate the front and rear in a vehicle front-rear direction, left and right in a vehicle left-right direction (vehicle width direction), and upward and downward in a vehicle vertical direction.

(Overall Configuration)

Figure 1:
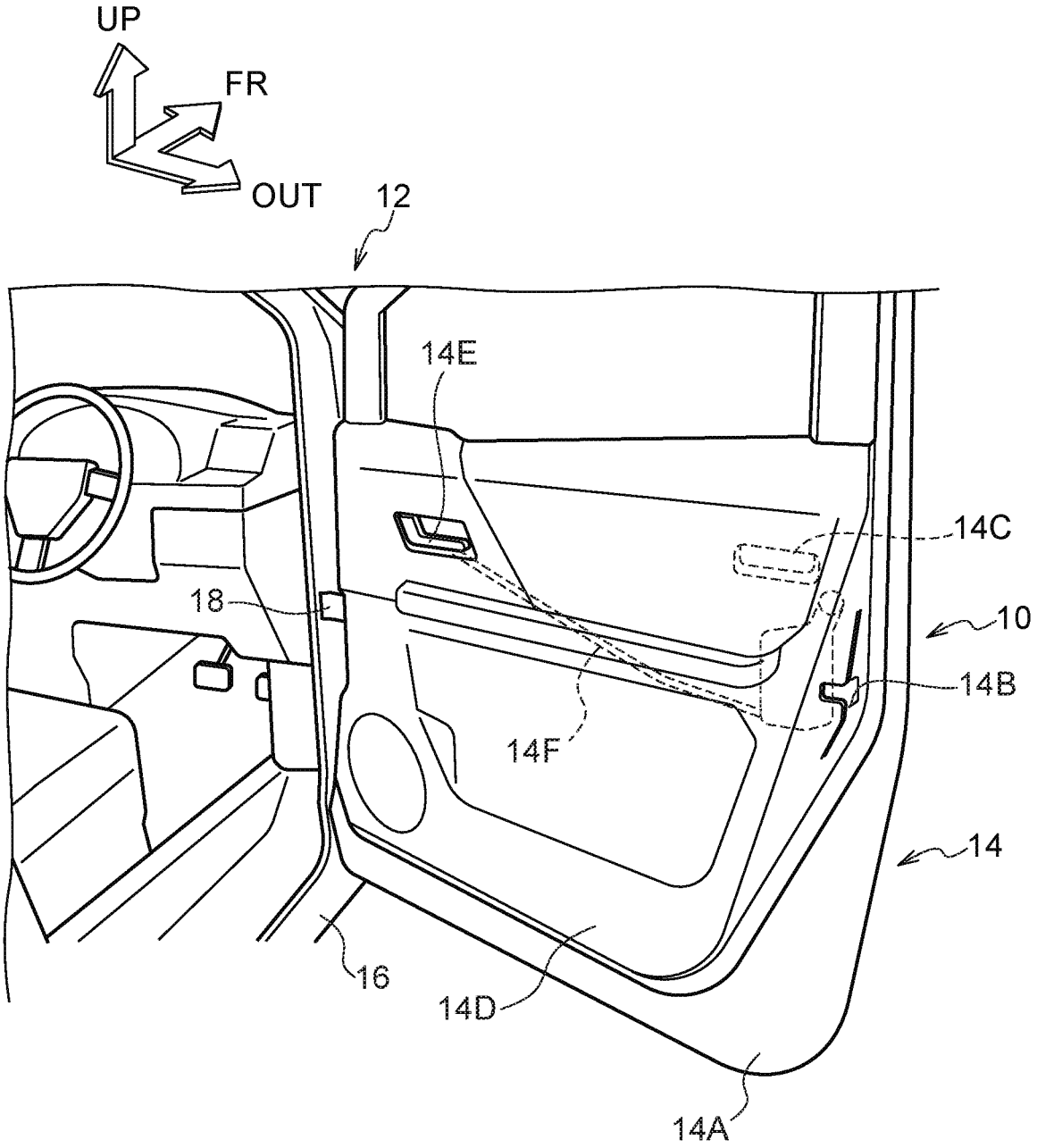
FIG. 1 is a schematic perspective view, viewed from a vehicle rear side, of an open state of a vehicle door having a vehicle door lock device according to a first exemplary embodiment.

As shown in FIG. 1, front door 14, which is a vehicle door in vehicle 12, is provided with vehicle door lock device 10. Front door 14 is attached to vehicle body 16 via hinge 18 in such a manner that front door 14 can open and close. Vehicle door lock device 10 is disposed at a position corresponding to a region that is demarcated between a door outer panel (not shown) provided at a vehicle width direction outer side, and door inner panel 14A provided at a vehicle width direction inner side, of front door 14, and corresponding to a striker opening part 14B (described below) provided at a vehicle rear side end part of front door 14. It should be noted that front door 14 is provided as a left-right pair in the vehicle width direction, and since the respective front doors 14 and vehicle door lock devices 10 have left-right symmetry, only vehicle door lock device 10 at the right-hand side is explained in the following.

Door outer handle 14C is provided at the door outer panel as an operative part. Door outer handle 14C is attached facing a vehicle outer side, and as one example, operation is enabled whereby an operator (not shown) outside the vehicle grips the handle and pulls it in a direction perpendicular to the surface of the door outer panel.

Door trim 14D is attached to door inner panel 14A from the vehicle width direction inner side as an inner fitting member. At a vehicle front side of door trim 14D, an inside lever opening part (not shown) is formed, at which door inner handle 14E is exposed, which serves as an operative part attached to door inner panel 14A, as a result of which a vehicle occupant (not shown) inside vehicle 12 can operate door inner handle 14E. Operation of door inner handle 14E, as one example, is enabled whereby the vehicle occupant grips the handle and pulls it in a direction perpendicular to the surface of door inner panel 14A.

Striker opening part 14B is formed at a vehicle rear side end part of door inner panel 14A. Striker opening part 14B is formed at a position corresponding to a striker (not shown) provided at vehicle body 16, and is formed in a shape such that the striker can be inserted inside door inner panel 14A at a time of a closed state of front door 14.

(Latch Unit)

Figure 2:
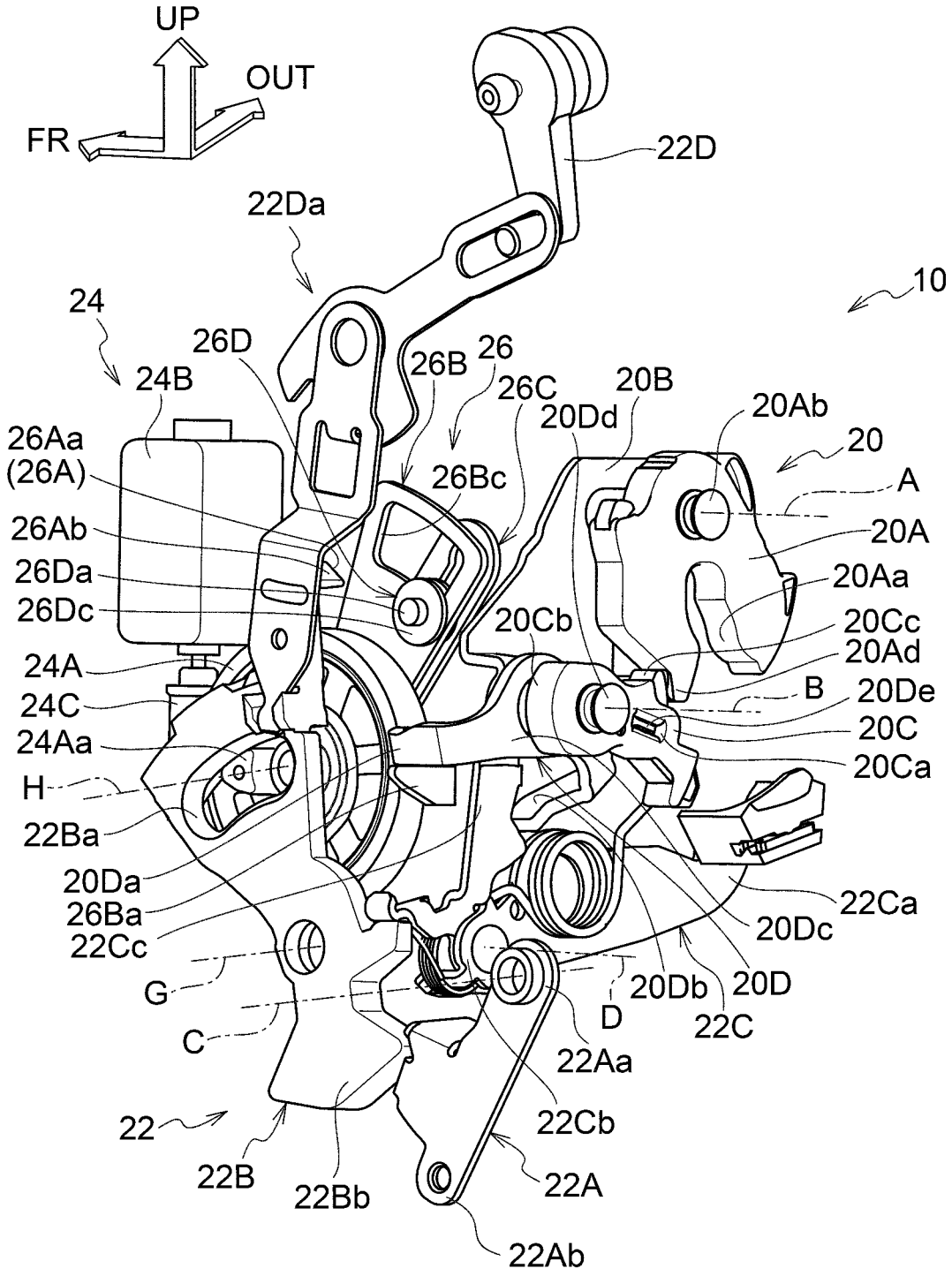
FIG. 2 is a schematic perspective view, viewed from a vehicle width direction inner side, of a latched state of a latch unit in the vehicle door lock device according to the first exemplary embodiment.

As shown in FIG. 2, vehicle door lock device 10 has, inside a unit case (not shown), latch unit 20, mechanical operation unit 22 and electrical operation unit 24. Latch unit 20 has latch 20A, latch retention bracket 20B, pawl 20C as a release part, and lift lever 20D. Latch 20A is formed, in a state viewed from the vehicle rear side, in a substantial U-shape having, at an inner part, striker insertion groove 20Aa and, in addition, is held by fastener 20Ab, rotatably around axis A, at a vehicle upper side of latch retention bracket 20B provided at a vehicle front side of latch 20A. It should be noted that latch 20A is biased by a spring (not shown) such that the opening of striker insertion groove 20Aa faces the vehicle width direction inner side (see FIG. 3). This state corresponds to the "unlatched state" recited in claim 1.

Lift lever 20D is provided at a vehicle lower side relative to latch 20A and, in addition, is formed in a substantial U-shape in vehicle plan view. Specifically, lift lever 20D is configured by first side wall part 20Da, which is provided so as to extend in substantially the vehicle front-rear direction, second side wall part 20Db, which is disposed at substantially a vehicle width direction outer side relative to first side wall part 20Da and which is provided so as to extend in substantially the vehicle front-rear direction, and connection wall part 20Dc, which connects a vehicle rear side end part of first side wall part 20Da with a vehicle rear side end part of second side wall part 20Db. Connection wall part 20Dc is held by fastener 20Dd, rotatably around axis B, at a vehicle lower side of latch retention bracket 20B. It should be noted that lift lever 20D is biased by a spring (not shown) in a direction in which first side wall part 20Da is pushed downward toward a vehicle lower side (and second side wall part 20Db is pushed upward toward a vehicle upper side).

Figure 4:
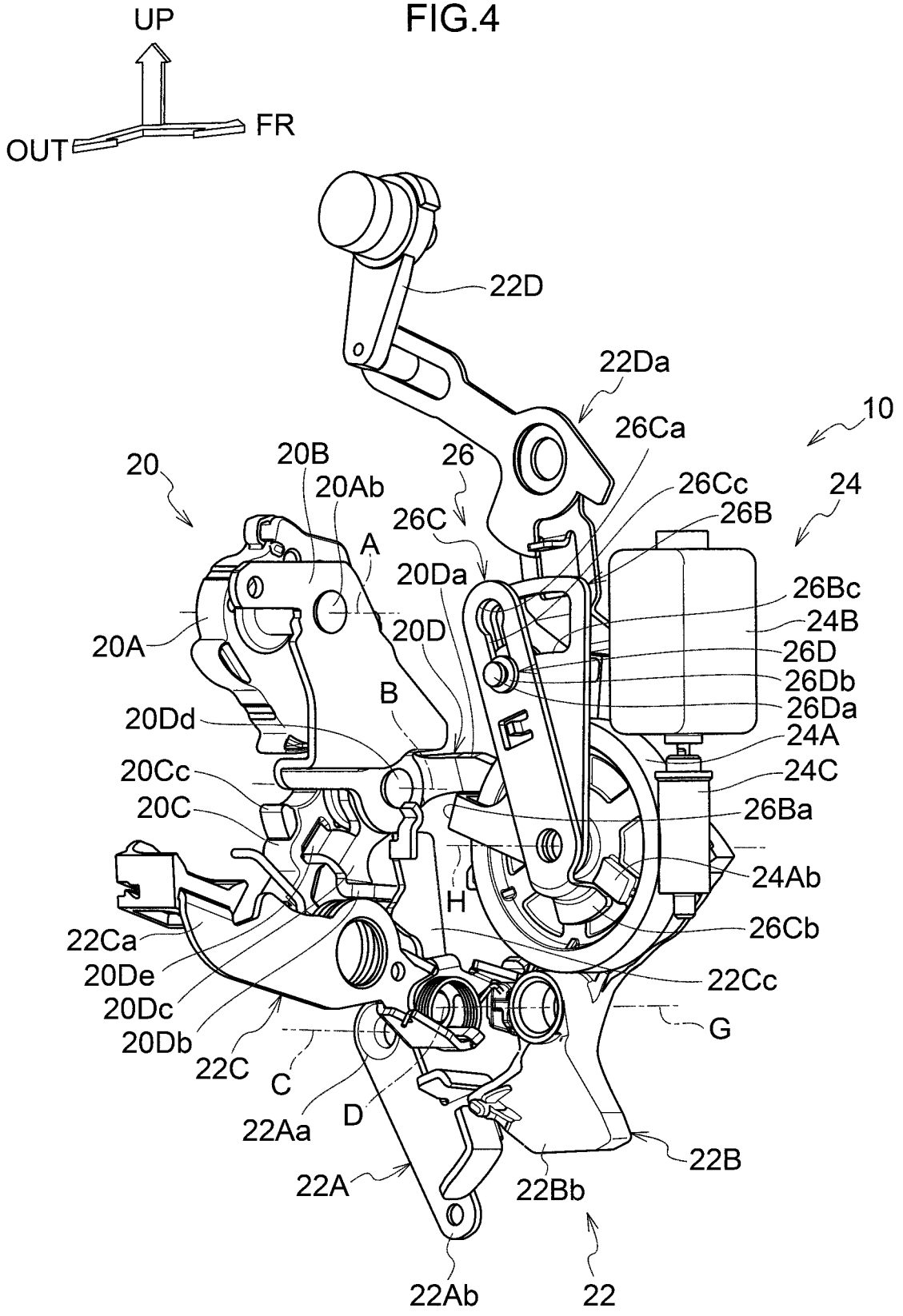
FIG. 4 is a schematic perspective view, viewed from a vehicle width direction outer side, of an unlatched state of a latch unit in the vehicle door lock device according to the first exemplary embodiment.
Figure 5:
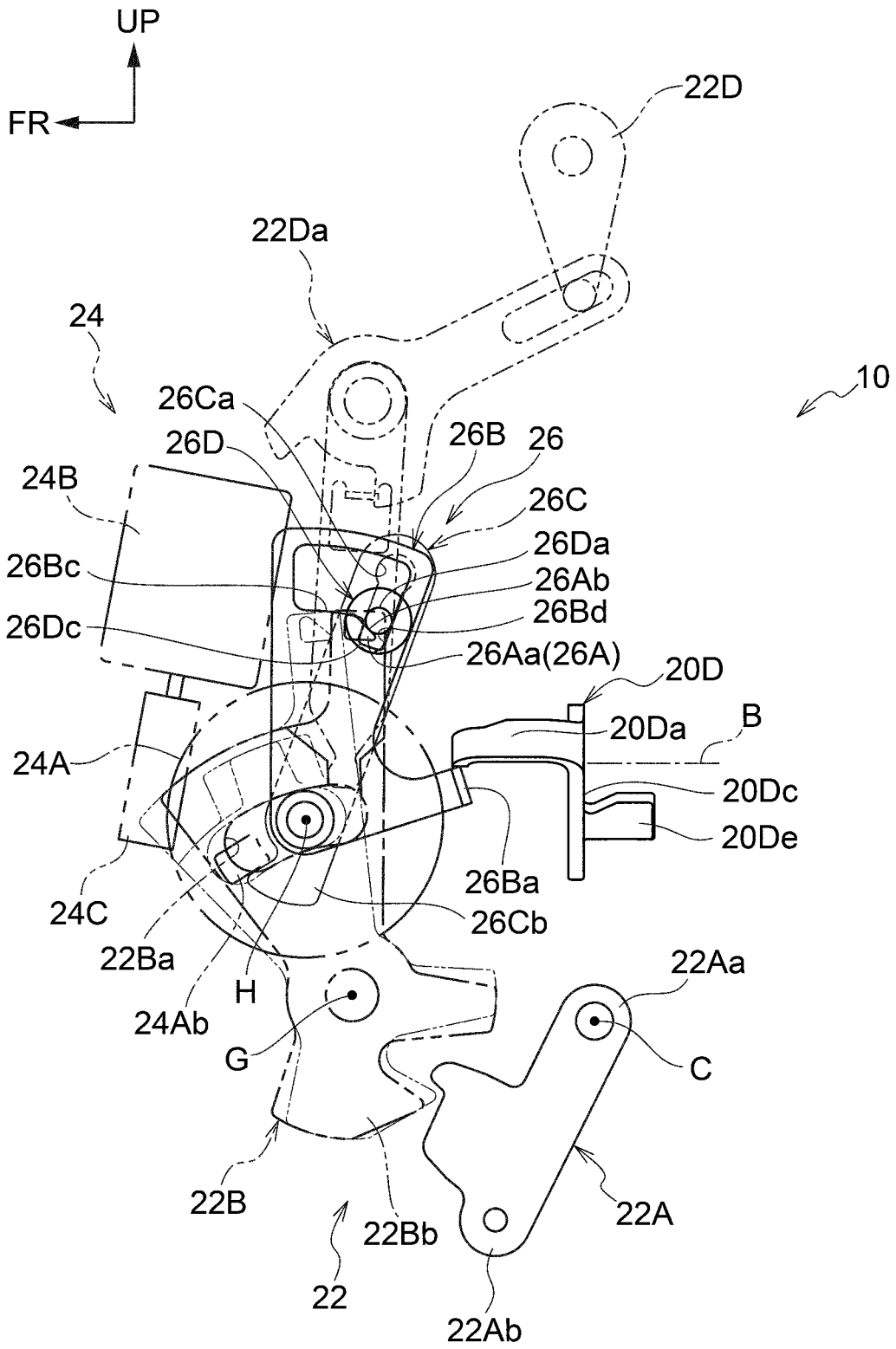
FIG. 5 is a schematic lateral view, viewed from the vehicle width direction inner side, of an initial stage when a cancellation unit has been operated in the vehicle door lock device according to the first exemplary embodiment.
Figure 6:
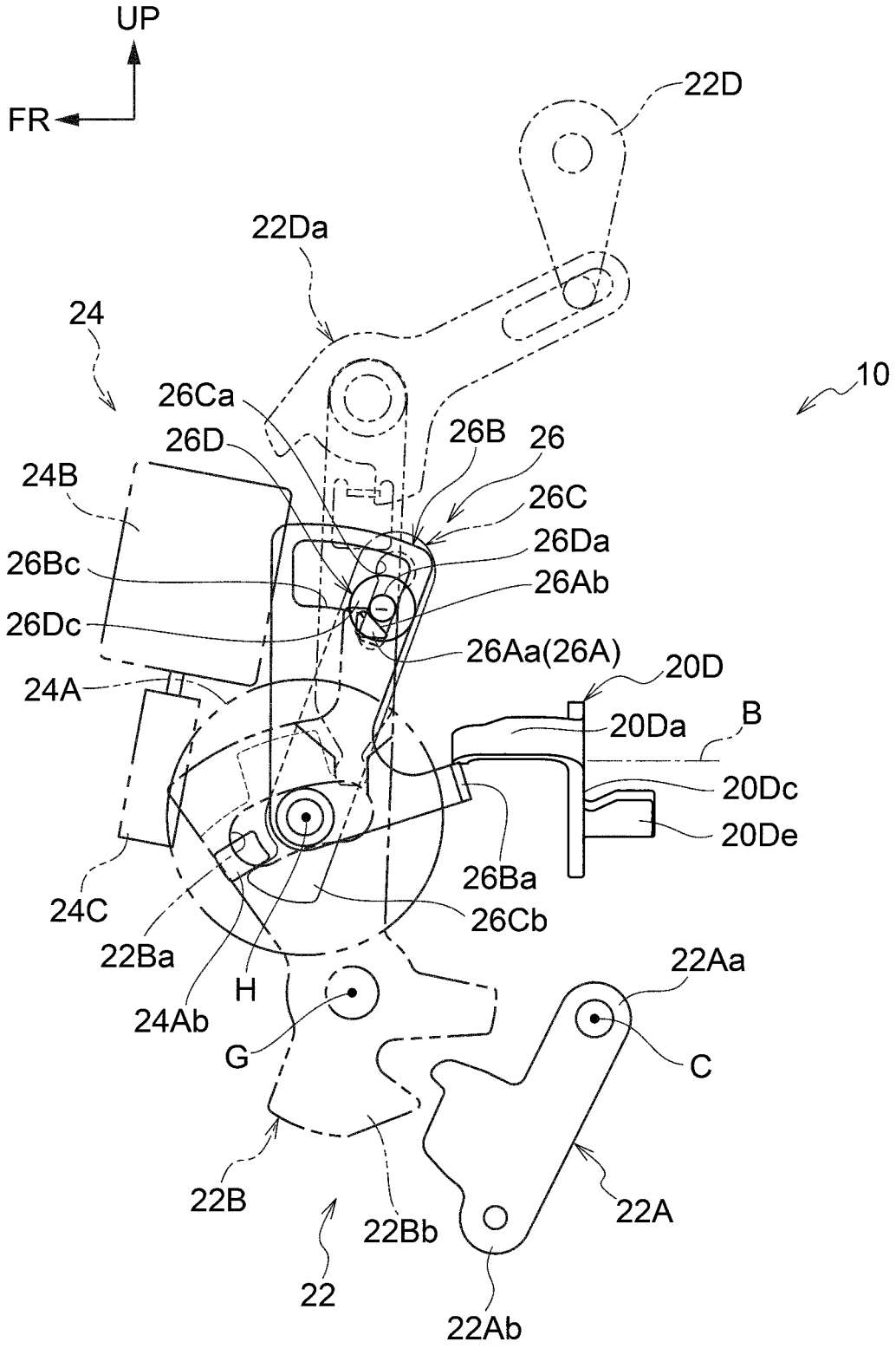
FIG. 6 is a schematic lateral view, viewed from the vehicle width direction inner side, of an intermediate stage when a cancellation unit has been operated in the vehicle door lock device according to the first exemplary embodiment.

Engagement claw part 20De is formed, protruding toward the vehicle rear side, at connection wall part 20Dc of lift lever 20D (see FIG. 4 and FIG. 5). Engagement claw part 20De is formed at a vehicle width direction outer side relative to axis B of connection wall part 20Dc, and engages with the inside of engagement hole part 20Ca of pawl 20C, which is described below.

Pawl 20C is provided at a vehicle lower side relative to latch 20A and, in addition, is formed in a substantially rectangular shape having its longitudinal direction in substantially the vehicle width direction. End part 20Cb at one side in the longitudinal direction of pawl 20C is held by fastener 20Dd, rotatably around axis B, at a vehicle lower side of latch retention bracket 20B, similarly to lift lever 20D. Further, engagement hole part 20Ca, which runs through in a vehicle front-rear direction, is formed at a substantially central part in a longitudinal direction of pawl 20C. Since engagement claw part 20De of lift lever 20D is engaged at engagement hole part 20Ca, pawl 20C rotates integrally with lift lever 20D.

Latch engagement claw part 20Cc is formed at a vehicle upper side at a substantial center in a longitudinal direction of pawl 20C. Latch engagement claw part 20Cc is formed in a shape that projects from pawl 20C substantially toward the vehicle upper side. Latch engagement claw part 20Cc is configured to abut a side face of latch 20A owing to the biasing force of lift lever 20D, in a state in which there is no external input to lift lever 20D (an non-operated state). It should be noted that when front door 14 is closed when latch 20A is in an unlatched state (see FIG. 3), latch 20A rotates such that the opening of striker insertion groove 20Aa faces the vehicle width direction outer side owing to the striker being inserted inside striker insertion groove 20Aa of latch 20A. Latch engagement claw part 20Cc of pawl 20C, which rotates integrally with lift lever 20D, which has pushed up second side wall part 20Db toward a vehicle upper side owing to a biasing force, engages at latch claw part 20Ad, which is formed at a side face of latch 20A, in this state. As a result of this, rotation of latch 20A is restricted and a closed state of front door 14 is maintained. It should be noted that this state corresponds to the "latched state" recited in claim 1.

(Mechanical Operation Unit)

Mechanical operation unit 22 is configured by inside lever 22A, active lever 22B, opening lever 22C, and key lever 22D, which serves as one operative part. Inside lever 22A is provided at a vehicle lower side relative to latch unit 20 and, in addition, vehicle upper side end part 22Aa is held, rotatably around axis C, by a fastener (not shown). Wire cable 14F (see FIG. 1), which is connected to door inner handle 14E, is attached to vehicle lower side end part 22Ab of inside lever 22A. Accordingly, inside lever 22A rotates in conjunction with operation of door inner handle 14E.

Opening lever 22C is provided at a vehicle lower side relative to latch unit 20 and, in addition, is held, rotatably around axis D, by a fastener (not shown). Further, a connection member of a rod or the like (not shown) connected to door outer handle 14C (see FIG. 1) is attached to end part 22Ca at a vehicle width direction outer side of opening lever 22C. Further, push-up part 22Cc, which projects toward the side of first side wall part 20Da of lift lever 20D, is attached, rotatably, to end part 22Cb at a vehicle width direction inner side of opening lever 22C. Further, opening lever 22C rotates so as to push down end part 22Ca toward the vehicle lower side when door outer handle 14C is operated by being pulled in a direction orthogonal to the face of the door outer panel. As a result of this, push-up part 22Cc at end part 22Cb pushes up first side wall part 20Da of lift lever 20D substantially toward the vehicle upper side.

Active lever 22B is provided at a vehicle front side relative to inside lever 22A, and in addition, is provided extending in a substantially vehicle vertical direction and has gear engagement hole 22Ba, lever abutment part 22Bb, and disengagement part 26A, which configures a part of cancellation unit 26, which is discussed below. Further, active lever 22B is held, rotatably around axis G between a locked position (the position shown in the drawing) and an unlocked position (see FIG. 9), by a fastener (not shown). When active lever 22B is in the locked position, transition of latch 20A from a latched state to an unlatched state is restricted even when door outer handle 14C or door inner handle 14E is operated. Further, when active lever 22B is in the unlocked position, latch 20A can be made to transition from a latched state to an unlatched state by operating door outer handle 14C or door inner handle 14E. That is, locking and unlocking of front door 14 can be performed by rotating active lever 22B. It should be noted that since the locking and unlocking of front door 14 at active lever 22B is similar to that of a standard vehicle door lock device and is a well-known technique, detailed explanation is omitted.

Disengagement part 26A is formed at a vehicle upper side of active lever 22B and, in addition, has release claw 26Aa, which projects toward a vehicle width direction outer side. Release claw 26Aa has inclined face 26Ab, which inclines toward a vehicle lower side on progression toward a vehicle rear side, and a vehicle rear side end part of inclined face 26Ab is disposed at a position corresponding to a vehicle lower side face of release side engagement hole part 26Bd at a position at which cancellation lever 26C, which is described below, puts latch unit 20 into an unlatched state (see FIG. 5).

Lever abutment part 22Bb is formed at a vehicle lower side of active lever 22B, and is formed so as to oppose inside lever 22A. Lever abutment part 22Bb abuts inside lever 22A in a case in which vehicle lower side end part 22Ab of inside lever 22A has rotated toward the vehicle front side (the clockwise direction as per FIG. 5) owing to operation of door inner handle 14E (see FIG. 1). As a result of this, lever abutment part 22Bb is caused to rotate toward the vehicle front side (the clockwise direction as per in FIG. 5) around axis G, and active lever 22B is moved to the unlocked position. That is, active lever 22B moves in conjunction with inside lever 22A.

Gear engagement hole 22Ba is formed at a vehicle lower side of disengagement part 26A, and is configured such that gear projection part 24Aa, which is formed at wheel gear 24A, which configures a part of electrical operation unit 24 and is described below, can be inserted inside gear engagement hole 22Ba. As a result of this, by rotating wheel gear 24A, active lever 22B can be made to rotate around axis G and moved to the locked position or to the unlocked position.

Key lever 22D is disposed at a vehicle upper side of active lever 22B and, in addition, is connected to active lever 22B via connection lever 22Da. Key lever 22D is connected to a key cylinder (not shown) provided at the door outer panel via a rod (not shown). Key lever 22D rotates active lever 22B around axis G via connection lever 22Da in response to the key cylinder being operated by a purpose-built key such as a vehicle ignition key held by a vehicle occupant. That is, active lever 22B moves in conjunction with key lever 22D.

(Electrical Operation Unit)

Electrical operation unit 24 has electromotive motor 24B as a drive unit, worm gear 24C attached so as to rotate integrally with an output axis of electromotive motor 24B, and wheel gear 24A that meshes with worm gear 24C. Electromotive motor 24B is electrically connected to a controller (not shown) provided with a CPU, and can be activated by operation of an open/close switch or the like (not shown) connected to the controller.

Wheel gear 24A is held, rotatably around axis H having an axial direction in substantially the vehicle width direction, by a fastener (not shown). Gear projection part 24Aa, which projects toward the vehicle width direction inner side, is formed at a vehicle width direction inner side of wheel gear 24A.

(Cancellation Unit)

Cancellation unit 26 has release lever 26B, which serves as a part of a lever member, cancellation lever 26C, which serves as another part of the lever member, cancellation pin 26D, and disengagement part 26A. Release lever 26B is disposed at a vehicle width direction outer side of wheel gear 24A, and is formed in a substantially rectangular plate shape having the vehicle width direction as a plate thickness direction and substantially the vehicle vertical direction as a longitudinal direction. Further, the vehicle lower side of release lever 26B is held by the fastener (not shown) that holds wheel gear 24A. That is, release lever 26B is configured rotatably around the same axis H as wheel gear 24A.

As shown in FIG. 4, push-up part 26Ba, which extends substantially toward a vehicle rear side and is folded back around a peripheral face of wheel gear 24A, is formed at release lever 26B. Push-up part 26Ba is disposed at a vehicle lower side of first side wall part 20Da of lift lever 20D. Accordingly, when, as shown in FIG. 5, release lever 26B rotates in an anticlockwise direction as per FIG. 5, release lever 26B pushes up first side wall part 20Da of lift lever 20D, thereby releasing engagement between pawl 20C and latch 20A (see FIG. 3).

First through-hole 26Bc, which runs through in a plate thickness direction, is formed at a vehicle upper side of release lever 26B. First through-hole 26Bc is formed in a substantially rectangular shape having a longitudinal direction in a substantially transverse direction of release lever 26B, and in addition, release side engagement hole part 26Bd (see FIG. 7) is formed at a vehicle rear side and vehicle lower side end part of first through-hole 26Bc. Release side engagement hole part 26Bd is formed as a cut-out towards a substantial vehicle lower side relative to a lower edge part of first through-hole 26Bc, and has a dimension in the substantial vehicle front-rear direction (the direction of rotation of wheel gear 24A) that is slightly larger than the diameter dimension of shaft 26Da (see FIG. 5) of cancellation pin 26D, which is described below. In other words, a boundary part between first through-hole 26Bc and release side engagement hole part 26Bd corresponds to connection part 26Bg (see FIG. 7), which connects the inside of release side engagement hole part 26Bd with the outside thereof. Further, the dimension of first through-hole 26Bc in the substantial vehicle front-rear direction (the direction of rotation of wheel gear 24A) is configured at a size such that push-up part 26Ba of release lever 26B does not push up first side wall part 20Da of lift lever 20D (i.e., pawl 20C engages with latch 20A) in a state in which cancellation pin 26D is inserted into first through-hole 26Bc and into cancellation side engagement hole part 26Cc, which is described below (see FIG. 8).

Cancellation lever 26C is disposed at a vehicle width direction outer side of release lever 26B, and similarly to release lever 26B, is formed in a substantial rectangular plate shape having the vehicle width direction as a plate thickness direction and substantially the vehicle vertical direction as a longitudinal direction. A vehicle lower side of cancellation lever 26C is held by the fastener (not shown) that holds wheel gear 24A. That is, cancellation lever 26C, similarly to release lever 26B, is configured rotatably around the same axis H as wheel gear 24A. Further, cancellation lever 26C and release lever 26B are disposed so as to overlap in the plate thickness direction.

Second through-hole 26Ca, which runs through in the plate thickness direction, is formed at a vehicle upper side of cancellation lever 26C. Second through-hole 26Ca is formed in a substantially circular shape as viewed in the plate thickness direction and, in addition, is provided at a position in cancellation lever 26C corresponding to a vehicle upper side and vehicle rear side of first through-hole 26Bc of release lever 26B. Further, cancellation side engagement hole part 26Cc is formed at a vehicle lower side of second through-hole 26Ca (see FIG. 7). Cancellation side engagement hole part 26Cc is formed as a cut-out from a vehicle lower side edge part of second through-hole 26Ca to a position in cancellation lever 26C corresponding to release side engagement hole part 26Bd of release lever 26B (see FIG. 5), and has a dimension in the substantial vehicle front-rear direction (the direction of rotation of wheel gear 24A) that is substantially identical to the dimension of release side engagement hole part 26Bd in the substantial vehicle front-rear direction (the direction of rotation of wheel gear 24A). It should be noted that second through-hole 26Ca is disposed at a vehicle upper side relative to connection part 26Bg of release side engagement hole part 26Bd, as viewed from the side of the vehicle. Accordingly, cancellation side engagement hole part 26Cc is formed so as to include a position corresponding to connection part 26Bg.

Gear engagement part 26Cb is formed at a vehicle lower side of cancellation lever 26C. Gear engagement part 26Cb is formed at a vehicle lower side relative to the fastener that holds wheel gear 24A et cetera, and is inflected toward the vehicle width direction inner side. Further, a vehicle front side of gear engagement part 26Cb is engageable with projection part 24Ab formed at a vehicle width direction outer side face of wheel gear 24A.

Cancellation pin 26D is inserted through release side engagement hole part 26Bd of release lever 26B and cancellation side engagement hole part 26Cc of cancellation lever 26C. Cancellation pin 26D has cylindrical shaft 26Da (see FIG. 5) having substantially the vehicle width direction as an axial direction, first washer 26Db provided at a vehicle width direction outer side end part of shaft 26Da, and second washer 26Dc (see FIG. 3) provided at a vehicle width direction inner side end part of shaft 26Da. A diameter dimension of first washer 26Db is larger than a substantial vehicle front-rear direction dimension of cancellation side engagement hole part 26Cc (see FIG. 7) of cancellation lever 26C.

Figure 3:
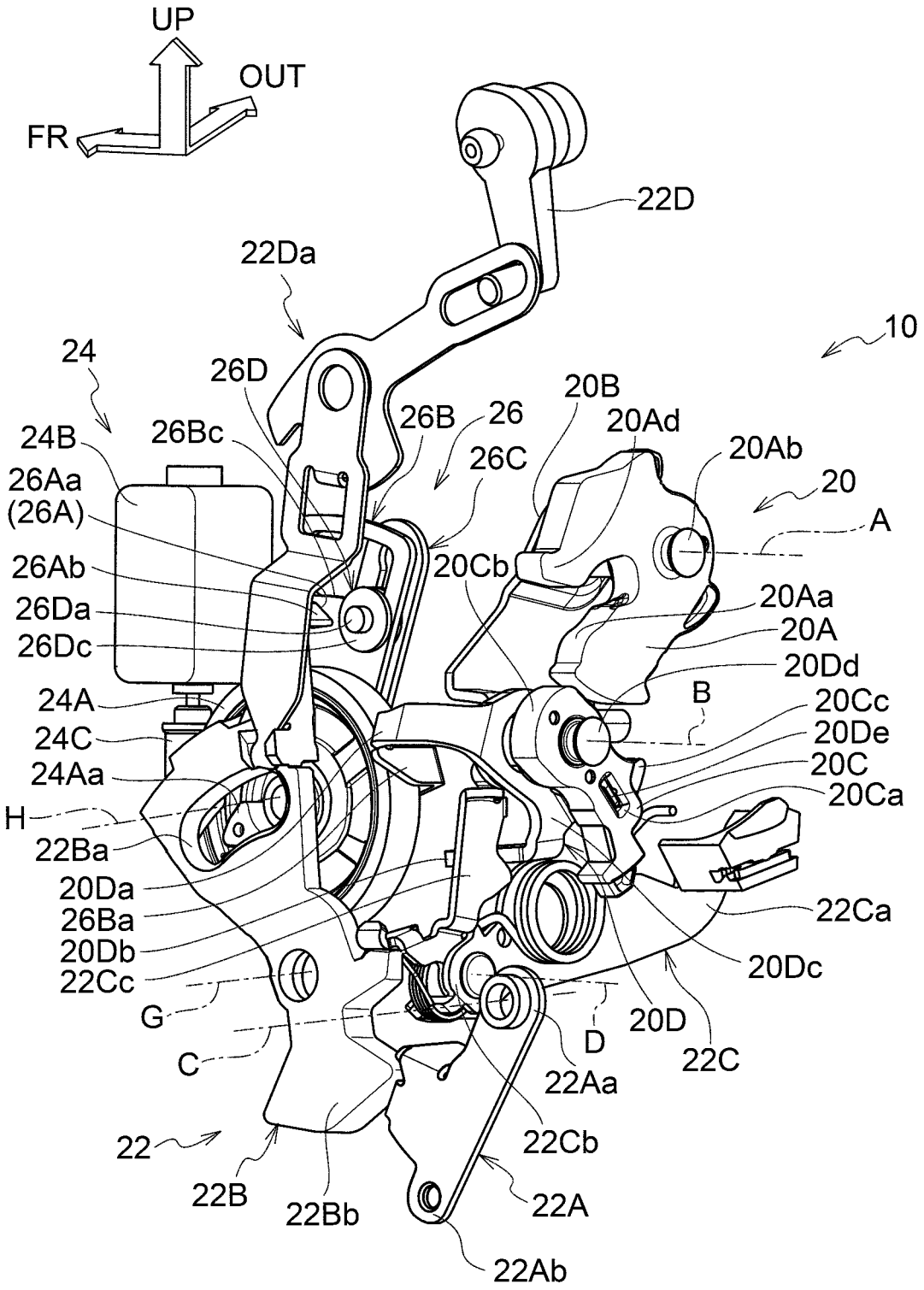
FIG. 3 is a schematic perspective view, viewed from the vehicle width direction inner side, of an unlatched state of a latch unit in the vehicle door lock device according to the first exemplary embodiment.

As shown in FIG. 3, second washer 26Dc has a larger dimension than a substantial vehicle front-rear direction of release side engagement hole part 26Bd (see FIG. 7) of release lever 26B. The above-described configuration renders cancellation lever 26C and release lever 26B integrally rotatable around axis H in conjunction with wheel gear 24A.

(Neutral State)

In a state in which front door 14 has been put in a closed state, the opening of striker insertion groove 20Aa is put in a state (a latched state) in which it faces substantially a vehicle width direction outer side, in a state in which the shaft of a striker (not shown) has been inserted inside striker insertion groove 20Aa of latch 20A, as shown in FIG. 2. In this state, latch claw part 20Ad of latch 20A engages with latch engagement claw part 20Cc of pawl 20C attached to lift lever 20D. As a result of this, the closed state of front door 14 is maintained. It should be noted that this state is referred to in the following as a "neutral state".

(Regarding Activation of the Electrical Operation Unit)

When operation of an open/close switch (not shown) is performed in order to put front door 14 in an open state from the neutral state, electromotive motor 24B of electrical operation unit 24 is made to rotate by a controller that is electrically connected to the open/close switch, and wheel gear 24A is rotated, via worm gear 24C, in the anticlockwise direction as per FIG. 5. As a result of this, as shown in FIG. 5, projection part 24Ab of wheel gear 24A abuts gear engagement part 26Cb of cancellation lever 26C, and cancellation lever 26C is rotated in the anticlockwise direction as per FIG. 5 around axis H. Accordingly, since release lever 26B, which is connected to cancellation lever 26C by cancellation pin 26D, also rotates in the anticlockwise direction as per FIG. 5 around axis H, push-up part 26Ba of release lever 26B pushes up first side wall part 20Da of lift lever 20D against the biasing force of lift lever 20D, as shown in FIGS. 3 and 4. Accordingly, since pawl 20C, which rotates integrally with lift lever 20D, moves in a direction away from latch 20A, the engagement between latch engagement claw part 20Cc and latch claw part 20Ad is released. As a result of this, latch 20A is rotated by a biasing force such that the opening of striker insertion groove 20Aa faces the vehicle width direction inner side (an unlatched state). As a result of this, front door 14 is put into an open state.

Further, when, by operation of the open/close switch in the above-described state, electromotive motor 24B of electrical operation unit 24 is made to rotate to the opposite side by the controller that is electrically connected to the open/close switch, and wheel gear 24A is made to rotate in the clockwise direction as per FIG. 5 via worm gear 24C, the force with which push-up part 26Ba of release lever 26B pushes up first side wall part 20Da of lift lever 20D against the biasing force of lift lever 20D, decreases. That is, push-up part 26Ba is pushed downward by the biasing force of lift lever 20D. Accordingly, pawl 20C, which rotates integrally with lift lever 20D, moves in a direction toward latch 20A. When, in this state, front door 14 is closed and latch 20A is rotated such that the opening of striker insertion groove 20Aa faces the vehicle width direction outer side, latch engagement claw part 20Cc engages with latch claw part 20Ad (a latched state). As a result of this, front door 14 is put into a closed state and this closed state is maintained.

(Regarding Activation of the Mechanical Operation Unit)

Further, since activation in a case in which door outer handle 14C and door inner handle 14E (see FIG. 1) are operated from the neutral state shown in FIG. 2 is the same as for a standard vehicle door lock device and is a well-known technique, detailed explanation is omitted.

(Regarding Activation of the Cancellation Unit)

Figure 7:
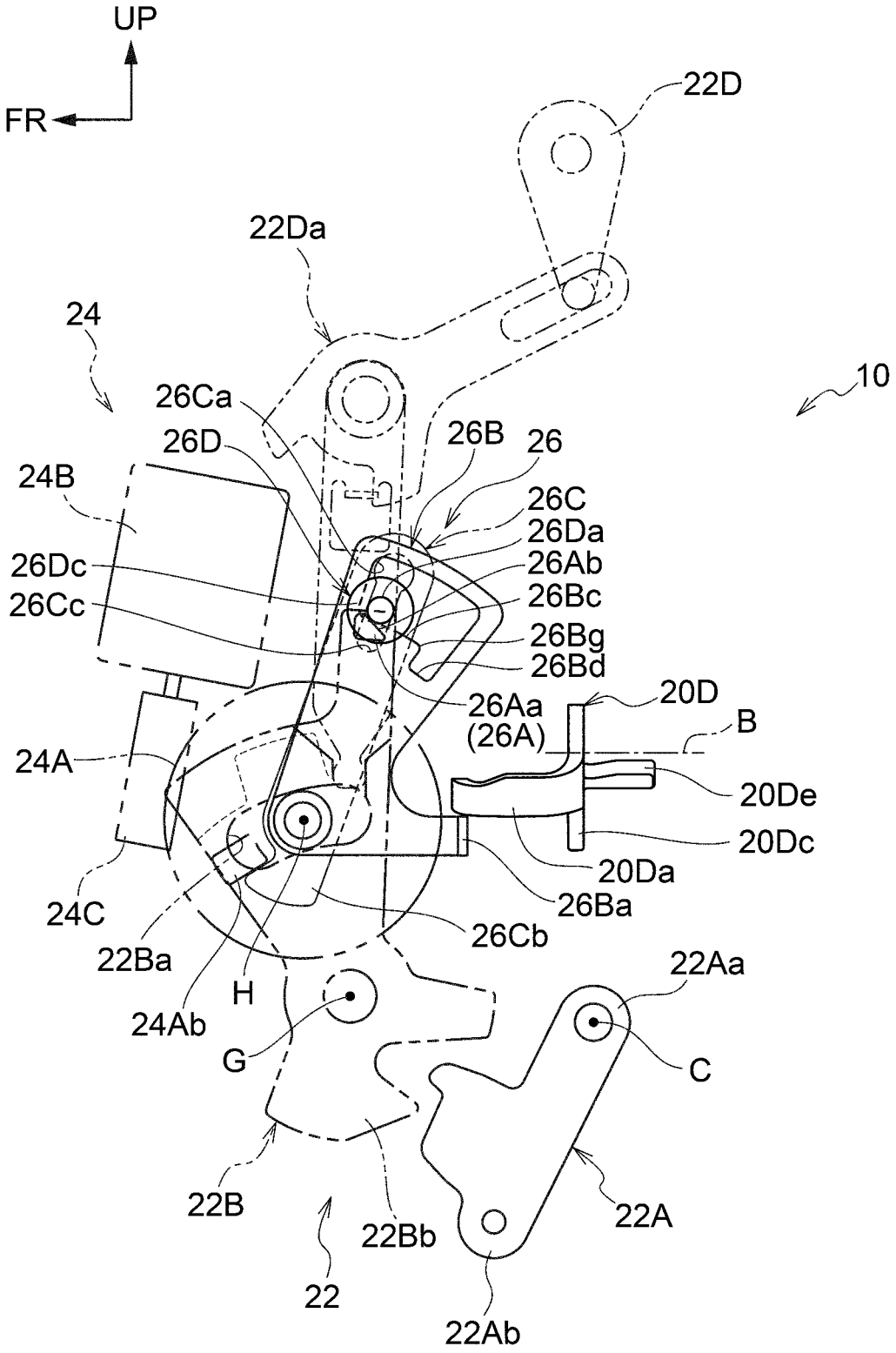
FIG. 7 is a schematic lateral view, viewed from the vehicle width direction inner side, of a latter stage when a cancellation unit has been operated in the vehicle door lock device according to the first exemplary embodiment.
Figure 8:
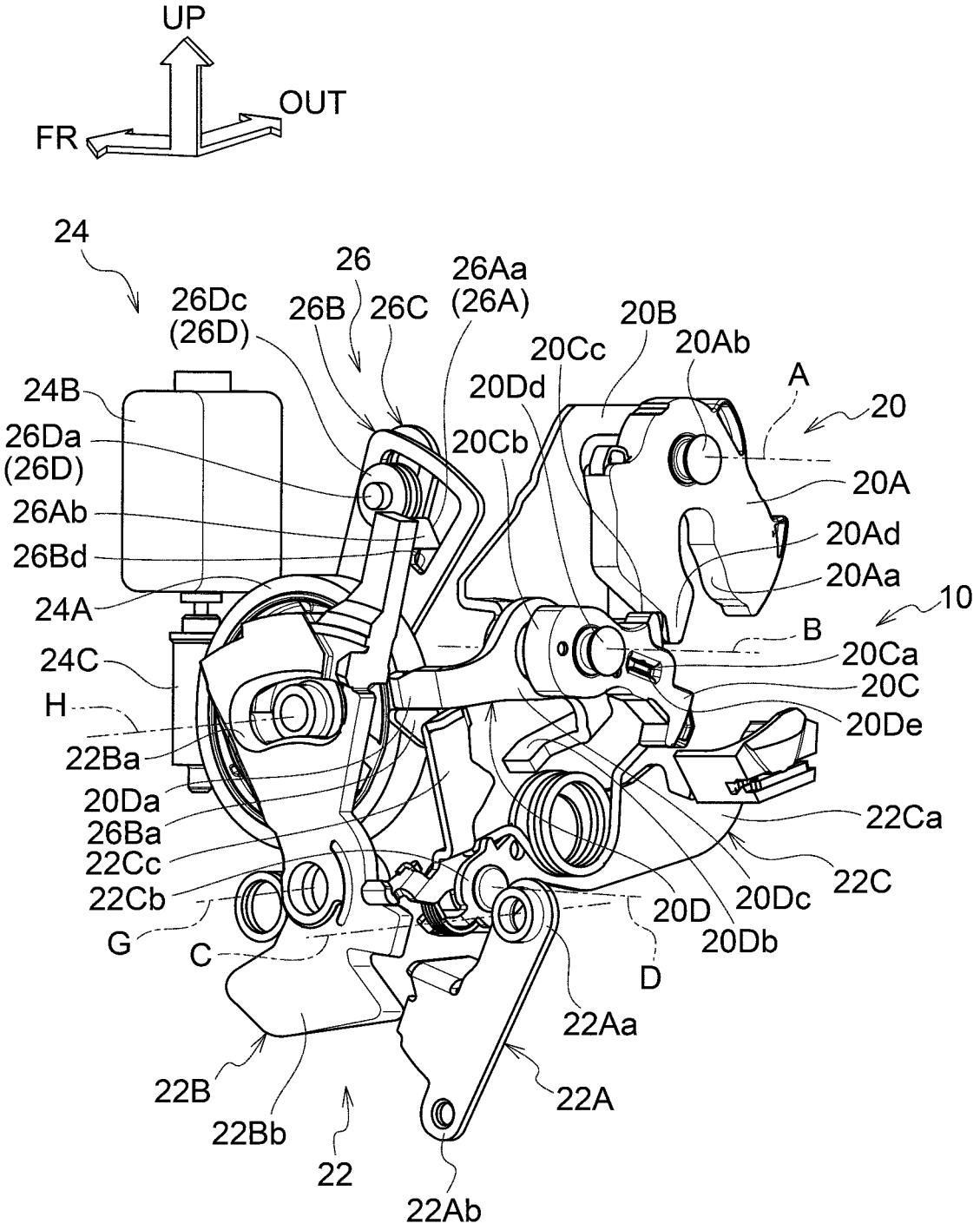
FIG. 8 is a schematic perspective view, viewed from the vehicle width direction inner side, of a latter stage when a cancellation unit has been operated in the vehicle door lock device according to the first exemplary embodiment.

When door inner handle 14E (see FIG. 1) is operated in a state in which, as shown in FIG. 3, first side wall part 20Da of lift lever 20D has been pushed up by electrical operation unit 24—that is, a state in which latch unit 20 is in an unlatched state and front door 14 is in an open state—inside lever 22A shown in FIG. 5 rotates in the clockwise direction as per FIG. 5 around axis C. In conjunction with this, active lever 22B also rotates in the clockwise direction as per FIG. 5 around axis G (in the drawing, rotation from the two-dot chain line to the bold dot-dash line). Further, disengagement part 26A of active lever 22B moves toward cancellation pin 26D and inclined face 26Ab pushes up cancellation pin 26D toward a substantially vehicle upper side (see FIG. 6). As a result of this, cancellation pin 26D is moved from release side engagement hole part 26Bd toward first through-hole 26Bc (engagement with release side engagement hole part 26Bd is released) (see FIG. 8). Therefore, the connection between release lever 26B and cancellation lever 26C is released and, as shown in FIG. 7, push-up part 26Ba of release lever 26B is pushed down toward a vehicle lower side by the biasing force of lift lever 20D. That is, release lever 26B rotates in the clockwise direction as per FIG. 7. As a result of this, latch engagement claw part 20Cc of pawl 20C, which is attached to lift lever 20D, moves in a direction toward latch claw part 20Ad of latch 20A. When, in this state, front door 14 is closed and latch 20A is rotated such that the opening of striker insertion groove 20Aa faces the vehicle width direction outer side, latch engagement claw part 20Cc engages with latch claw part 20Ad (a latched state; see FIG. 2). As a result of this, front door 14 is put in a closed state and this closed state is maintained. It should be noted that active lever 22B also moves in conjunction with key lever 22D, as described above. Accordingly, disengagement part 26A of active lever 22B is configured such that it can be actuated, similarly to by operation of door inner handle 14E, by rotation of key lever 22D via the key cylinder.

Figure 9:
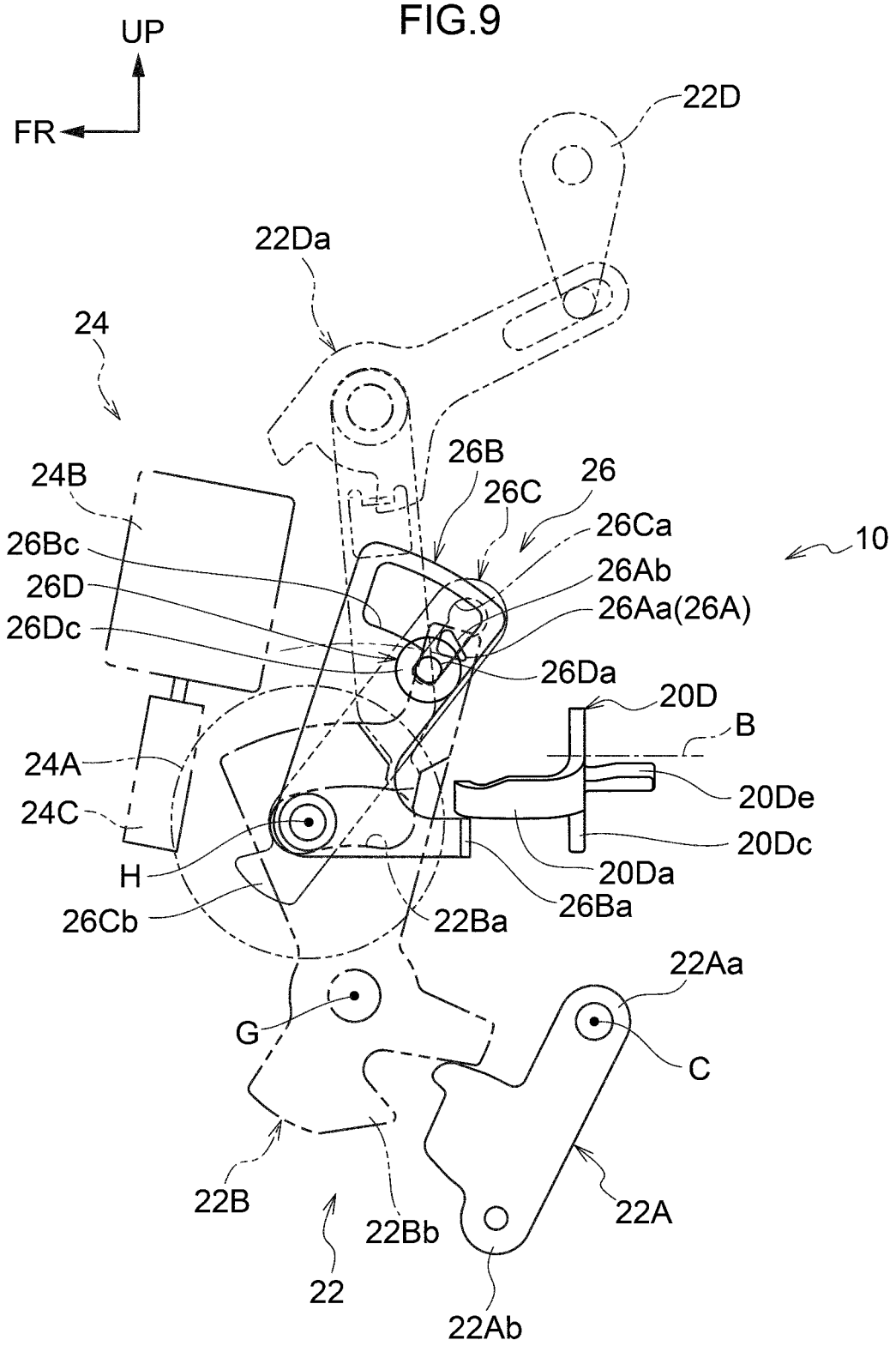
FIG. 9 is a schematic lateral view, viewed from the vehicle width direction inner side, of a locked state of an active lever in the vehicle door lock device according to the first exemplary embodiment.

Further, as shown in FIG. 9, the positions of disengagement part 26A, cancellation pin 26D, release side engagement hole part 26Bd and cancellation side engagement hole part 26Cc are established such that disengagement part 26A of active lever 22B does not contact cancellation pin 26D even if active lever 22B is rotated in the clockwise direction as per FIG. 9, so as to be put into an unlocked state, in a state (a latched state) in which push-up part 26Ba of release lever 26B has not pushed up first side wall part 20Da of lift lever 20D.

Mechanism and Effect of First Exemplary Embodiment

Figure 10:
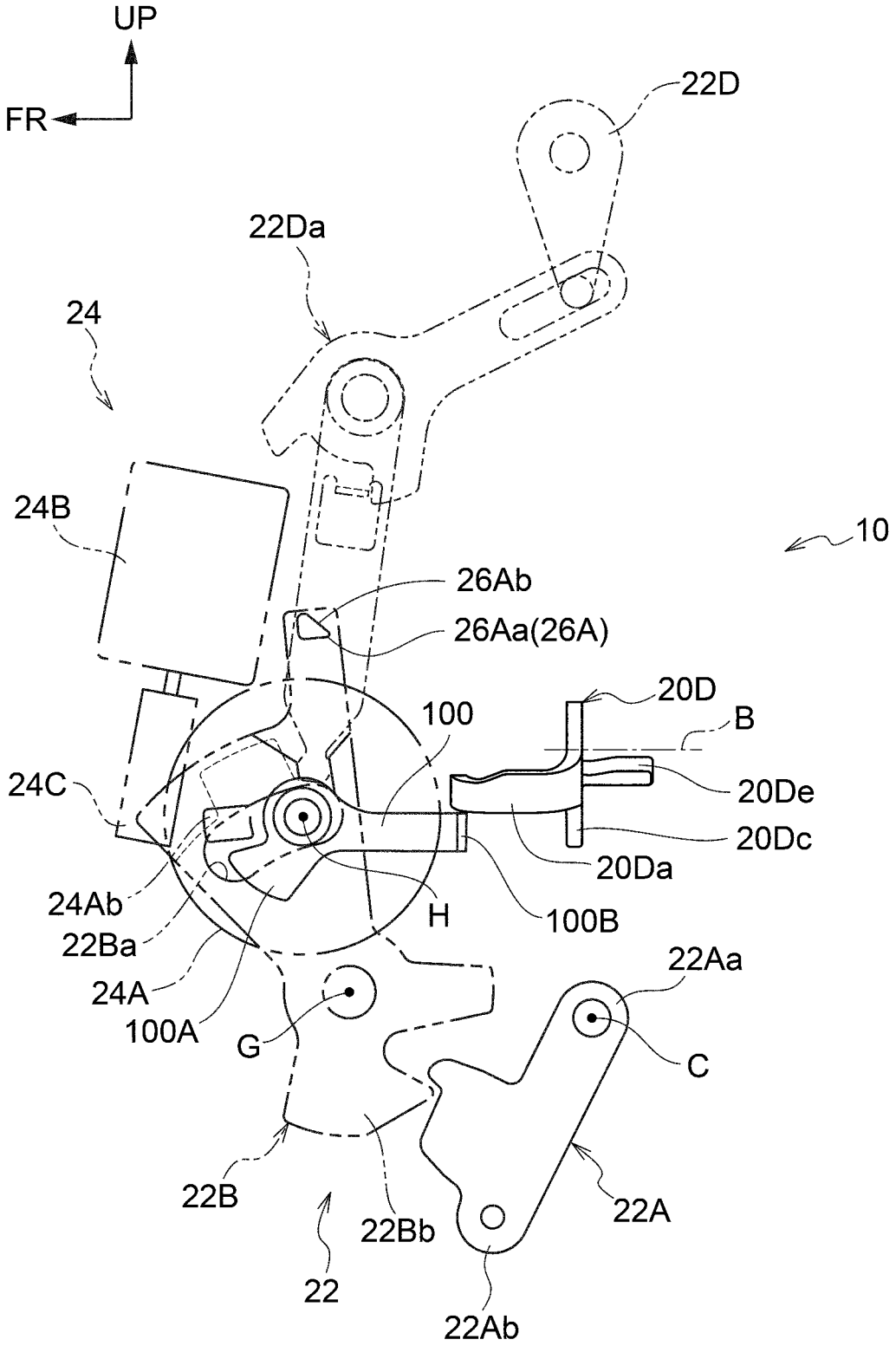
FIG. 10 is a schematic lateral view, viewed from a vehicle width direction inner side, of a latched state of a latch unit in a vehicle door lock device according to a comparative example.
Figure 11:
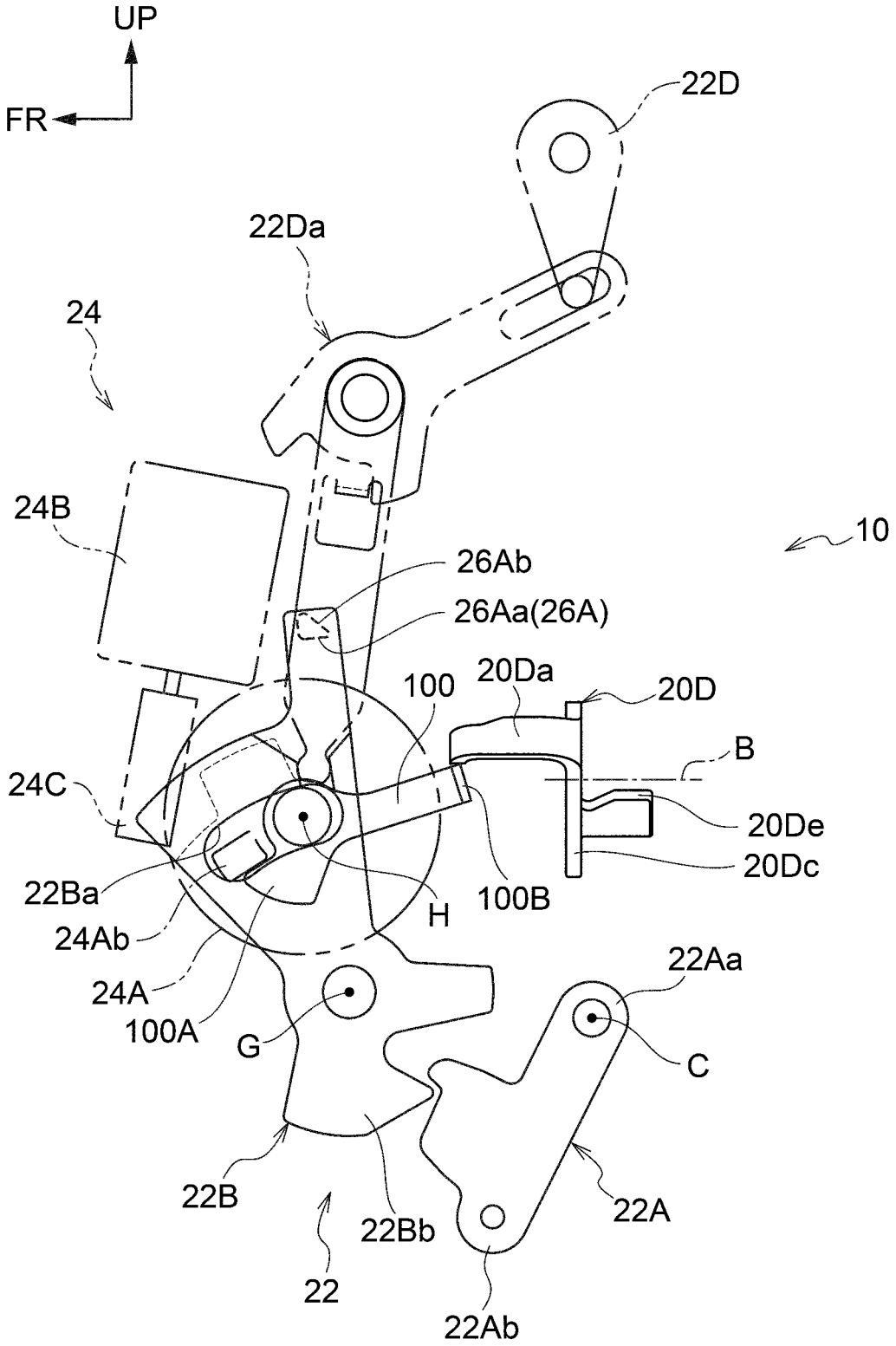
FIG. 11 is a schematic lateral view, viewed from a vehicle width direction inner side, of an unlatched state of a latch unit in a vehicle door lock device according to a comparative example.

Here, while using the comparative examples shown in FIG. 10 and FIG. 11, the mechanism and effect of the present exemplary embodiment is explained. It should be noted that portions of the comparative examples having identical configuration to the present exemplary embodiment are assigned the same reference numerals and explanation thereof is omitted.

As shown in FIG. 10, lever member 100 is provided at a vehicle width direction outer side of wheel gear 24A. Lever member 100 has the vehicle width direction as its plate thickness direction and is held by the fastener (not shown) that holds wheel gear 24A. That is, lever member 100 is configured rotatably around the same axis H as wheel gear 24A.

Gear engagement part 100A is formed at lever member 100. A vehicle front side of gear engagement part 100A is engageable with projection part 24Ab of wheel gear 24A. That is, when wheel gear 24A rotates in the anticlockwise direction as per FIG. 10, lever member 100 rotates integrally with wheel gear 24A.

Push-up part 100B, which extends toward the substantial vehicle rear side and is folded back over a peripheral face of wheel gear 24A is formed at lever member 100. Push-up part 100B is disposed at a vehicle lower side of first side wall part 20Da of lift lever 20D. Accordingly, as shown in FIG. 11, when lever member 100 rotates in the anticlockwise direction as per FIG. 11 owing to rotation of wheel gear 24A due to activation of electrical operation unit 24, lever member 100 pushes up first side wall part 20Da of lift lever 20D and engagement between pawl 20C and latch 20A is released (see FIG. 3).

However, in a case in which electrical operation unit 24 malfunctions in a state in which lever member 100 has pushed up first side wall part 20Da of lift lever 20D, the engagement between pawl 20C and latch 20A remains in a released state. That is, since the rotation of latch 20A cannot be stopped and an unlatched state is maintained, even if front door 14 (see FIG. 1) is then put into a closed state from an open state by a vehicle occupant, the closed state cannot be maintained and, therefore, front door 14 returns to an open state contrary to the intentions of the vehicle occupant. Accordingly, there is a possibility that the vehicle cannot be made to travel.

In contrast, in the present exemplary embodiment, as shown in FIG. 2, vehicle door lock device 10 has latch unit 20, mechanical operation unit 22 and electrical operation unit 24. Latch unit 20 is provided at front door 14, and in addition, can selectively adopt an unlatched state that enables front door 14 to be opened relative to vehicle body 16 or a latched state that maintains a closed state of front door 14 relative to vehicle body 16. Latch unit 20 transitions from an unlatched state to a latched state when, in an unlatched state, front door 14 is closed relative to vehicle body 16. Further, mechanical operation unit 22 switches latch unit 20 from a latched state to an unlatched state by operation of door outer handle 14C or door inner handle 14E. Further, electrical operation unit 24 is connected to electromotive motor 24B and switches latch unit 20 to a latched state or an unlatched state by means of the motive power of electromotive motor 24B. Accordingly, the operational force required when a vehicle occupant puts front door 14 into an open state or a closed state, can be reduced by electrical operation unit 24.

Here, vehicle door lock device 10 has cancellation unit 26, and cancellation unit 26 can release the connection between electrical operation unit 24 and mechanical operation unit 22. Accordingly, in a case in which electrical operation unit 24 has malfunctioned, active lever 22B of mechanical operation unit 22 is operated by door inner handle 14E or key lever 22D, or cancellation unit 26 is operated via key lever 22D, and the connection between electrical operation unit 24 and mechanical operation unit 22 is released. As a result of this, it is possible to avoid a situation in which latch unit 20 remains in an unlatched state caused by electrical operation unit 24. That is, latch unit 20, which has been uncoupled from electrical operation unit 24, transitions from an unlatched state to a latched state when front door 14 is closed. That is, front door 14 can be maintained in a closed state even in a case in which electrical operation unit 24 has malfunctioned.

Further, cancellation unit 26 is configured to be operable by door inner handle 14E or key lever 22D. That is, since door inner handle 14E or key lever 22D, which operate mechanical operation unit 22, can also be used in the operation of cancellation unit 26, it is possible to reduce the number of components.

In addition, latch unit 20 has pawl 20C. Pawl 20C can selectively adopt an engaged state with latch 20A or a non-engaged state with latch 20A. Further, wheel gear 24A of electrical operation unit 24 is engaged with electromotive motor 24B and, in addition, is configured rotatably with release lever 26B, cancellation lever 26C and cancellation pin 26D. Release lever 26B, cancellation lever 26C and cancellation pin 26D are configured integrally and have a part that is engaged with wheel gear 24A, and are configured so as to enable switching between the engaged state and the non-engaged state of pawl 20C by displacement in conjunction with the rotation of wheel gear 24A. Accordingly, by activating electromotive motor 24B, it is possible to switch between a latched state and an unlatched state of latch unit 20. That is, owing to the above-described simple configuration, operation of latch unit 20 can be performed by using drive force from electromotive motor 24B.

That is, cancellation unit 26 has release lever 26B, cancellation lever 26C that is engaged with wheel gear 24A and that has cancellation side engagement hole part 26Cc formed at a position corresponding to release side engagement hole part 26Bd of release lever 26B, and cancellation pin 26D. Cancellation pin 26D is inserted so as to engage with each of release side engagement hole part 26Bd and cancellation side engagement hole part 26Cc. Accordingly, since cancellation lever 26C and release lever 26B are, so to speak, connected by cancellation pin 26D, it is possible to switch between the engaged state and the non-engaged state of pawl 20C relative to latch 20A by the displacement of cancellation lever 26C and release lever 26B in conjunction with the rotation of wheel gear 24A and by the operation of lift lever 20D. That is, operation of latch unit 20 can be performed by using drive force from electromotive motor 24B.

Here, cancellation unit 26 has disengagement part 26A, and disengagement part 26A releases the engagement of cancellation pin 26D with release side engagement hole part 26Bd. As a result of this, since the connection between cancellation lever 26C and release lever 26B is released and cancellation lever 26C and release lever 26B become capable of movement relative to each other, it is possible to switch between a latched state and an unlatched state of latch unit 20 by switching between an engaged state and a non-engaged state of pawl 20C relative to latch 20A by moving release lever 26B, even if electromotive motor 24B malfunctions. That is, owing to the above-described simple configuration, latch unit 20 can be released from being held in a closed state or an open state.

Further, disengagement part 26A of cancellation unit 26 is provided at active lever 22B. Active lever 22B configures a part of mechanical operation unit 22 and switches between a locked state that restricts transition of pawl 20C from an engaged state to a non-engaged state, and an unlocked state that permits transition of pawl 20C from an engaged state to a non-engaged state, by operation of door inner handle 14E or key lever 22D. That is, door inner handle 14E and key lever 22D, which operate mechanical operation unit 22, can also be used in the operation of cancellation unit 26. Accordingly, the number of components can be reduced. As a result of this, costs can be reduced.

In addition, key lever 22D, which is provided at a vehicle width direction outer side of front door 14, and inside lever 22A, which is provided at a vehicle width direction inner side of front door 14, are linked via active lever 22B. Further, key lever 22D is configured to be operable via the key cylinder provided at the door outer panel. Further, inside lever 22A is configured to be operable via door inner handle 14E (see FIG. 1). Disengagement part 26A of active lever 22B is configured to be operable by these operations. Accordingly, a vehicle occupant can also operate cancellation unit 26 by conventional opening and closing operations of front door 14. That is, operation of cancellation unit 26 can be performed easily.

Furthermore, connection part 26Bg, which connects release side engagement hole part 26Bd with a vehicle front side of first through-hole 26Bc, is formed at a part of an outer edge part of release side engagement hole part 26Bd. Accordingly, cancellation pin 26D, which has been inserted inside release side engagement hole part 26Bd, can be released from the release side engagement hole part 26Bd by moving the cancellation pin 26D to first through-hole 26Bc via connection part 26Bg. Further, since cancellation side engagement hole part 26Cc engages with cancellation pin 26D at a position corresponding to connection part 26Bg, cancellation pin 26D engages with cancellation side engagement hole part 26Cc even in a state in which engagement of cancellation pin 26D with release side engagement hole part 26Bd has been released. Accordingly, since this is a state in which cancellation pin 26D remains at cancellation side engagement hole part 26Cc, the operation of once more inserting cancellation pin 26D into release side engagement hole part 26Bd after cancellation unit 26 has been activated, is facilitated. As a result of this, ease of maintenance can be improved.

Second Exemplary Embodiment

Figure 12:
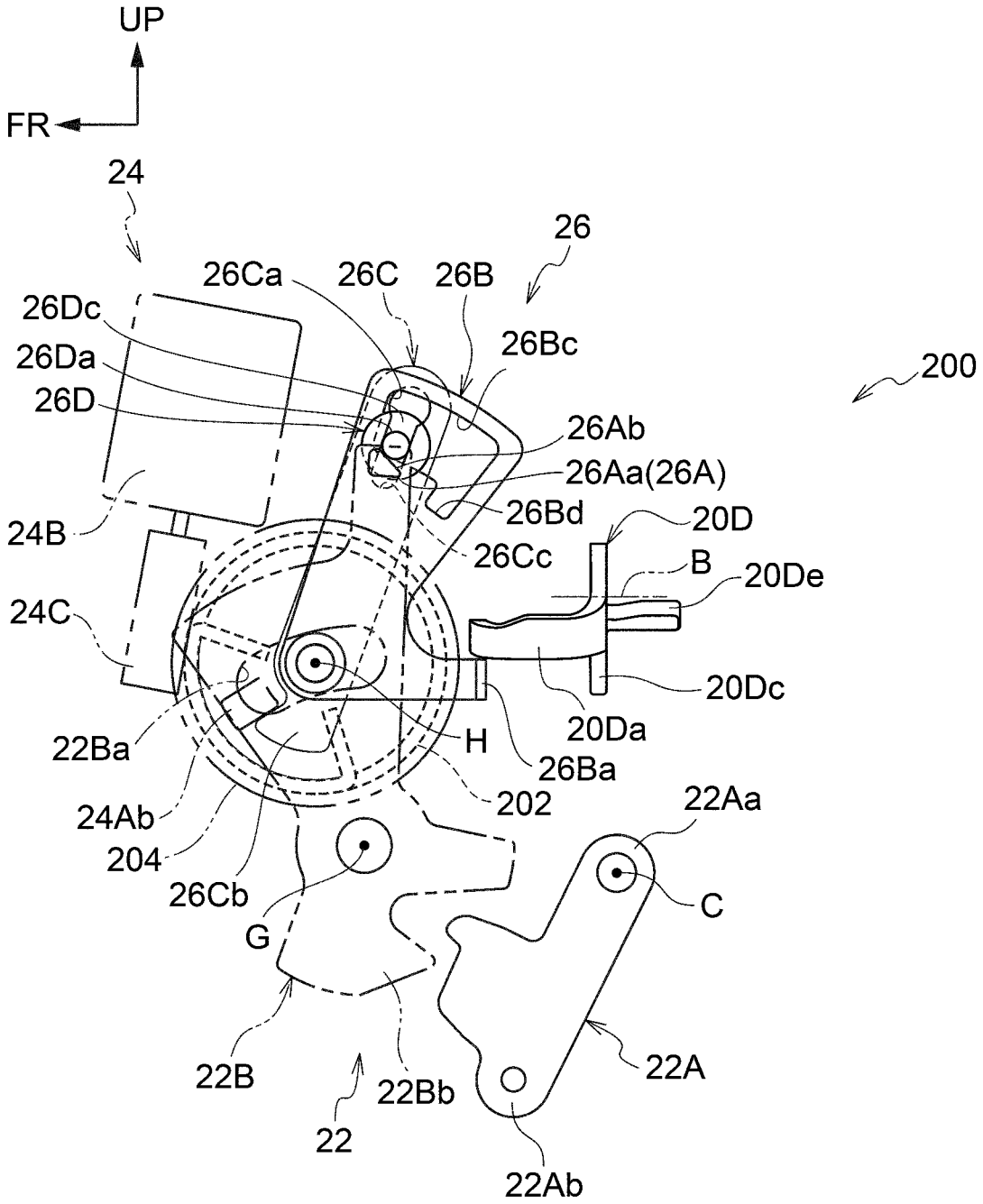
FIG. 12 is a schematic lateral view, viewed from a vehicle width direction inner side, of a latched state of a latch unit in a vehicle door lock device according to a second exemplary embodiment.
Figure 13:
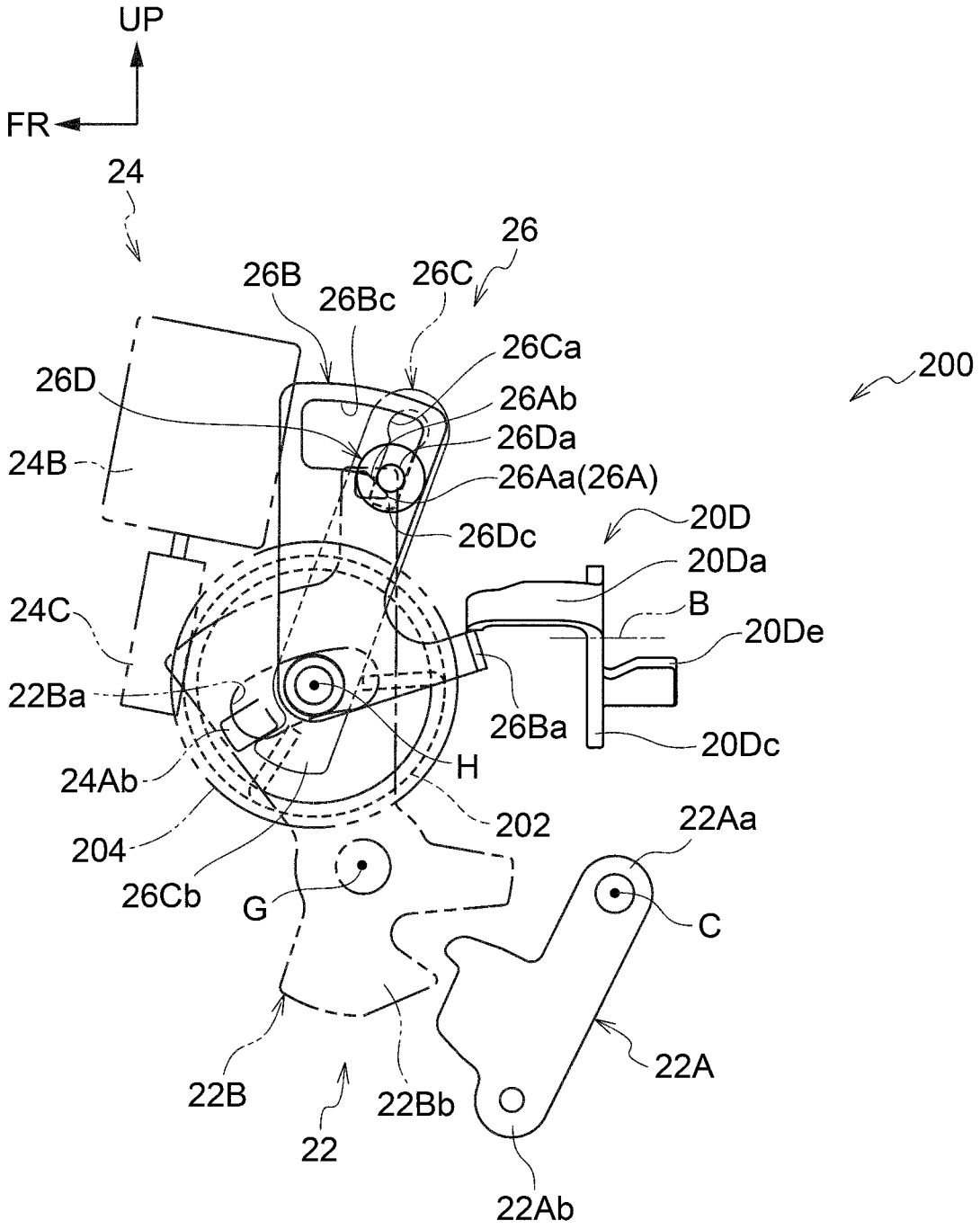
FIG. 13 is a schematic lateral view showing a state, viewed from a vehicle width direction inner side, of a latch unit at a time of movement from a latched state to an unlatched state in the vehicle door lock device according to the second exemplary embodiment

Next, vehicle door lock device 200 according to a second exemplary embodiment of the present disclosure is explained using FIG. 12 and FIG. 13. It should be noted that portions of the configuration that are identical to the first exemplary embodiment described above are assigned the same reference numerals and explanation thereof is omitted.

Vehicle door lock device 200 according to the second exemplary embodiment has a similar basic configuration to the first exemplary embodiment, and is characterized by the provision of neutral state recovery spring 202.

That is, as shown in FIG. 12, wheel gear 204, which is provided at electrical operation unit 24, is held, rotatably around axis H having substantially the vehicle width direction as an axial direction, by a fastener (not shown). Neutral state recovery spring 202 is attached to the fastener for holding wheel gear 204. Neutral state recovery spring 202 biases wheel gear 204 toward rotation in the clockwise direction as per FIG. 12 around axis H. Accordingly, in a case in which electromotive motor 24B is activated and latch unit 20 is switched from a latched state to an unlatched state, as shown in FIG. 13, electromotive motor 24B is made to rotate such that wheel gear 204 rotates in the anticlockwise direction as per FIG. 13 against the biasing force of neutral state recovery spring 202. As a result of this, since cancellation lever 26C and release lever 26B, which rotate integrally with wheel gear 204, also rotate in the anticlockwise direction as per FIG. 13, push-up part 26Ba of release lever 26B pushes up first side wall part 20Da of lift lever 20D against the biasing force of lift lever 20D. Accordingly, since pawl 20C, which rotates integrally with lift lever 20D, moves in a direction away from latch 20A, engagement between latch engagement claw part 20Cc and latch claw part 20Ad is released (see FIG. 3).

Here, in a case in which an electrical fault has occurred at electrical operation unit 24—that is, in a case in which electromotive motor 24B is not activated by operation of the open/close switch—and in a case in which worm gear 24C and wheel gear 204 are themselves rotatable, wheel gear 204 rotates in the clockwise direction as per FIG. 12 owing to the biasing force of neutral state recovery spring 202, as shown in FIG. 12. As a result of this, cancellation lever 26C and release lever 26B, which rotate integrally with wheel gear 204, also rotate in the clockwise direction as per FIG. 12, and push-up part 26Ba of release lever 26B moves away from first side wall part 20Da of lift lever 20D toward a vehicle lower side. Further, latch engagement claw part 20Cc of pawl 20C, which is attached to lift lever 20D, is configured to approach latch claw part 20Ad of latch 20A and to be engageable with latch claw part 20Ad (see FIG. 2). That is, since a latched state of latch 20A can be maintained, a closed state of front door 14 can be maintained. It should be noted that the above-described "electrical fault" of electrical operation unit 24 includes, for example, cases in which although worm gear 24C and wheel gear 204 are themselves rotatable, electromotive motor 24B does not activate owing to a controller or open/close switch malfunction. In contrast, a state in which foreign matter penetrates between worm gear 24C and wheel gear 204 and damages the teeth of worm gear 24C or wheel gear 204, whereby worm gear 24C or wheel gear 204 does not rotate (locks), is referred to in the following explanation as a "mechanical fault". In the case of mechanical fault, a closed state of front door 14 can be maintained, similarly to in the first exemplary embodiment, by activating cancellation unit 26.

Mechanism and Effect of Second Exemplary Embodiment

Next, the mechanism and effect of the second exemplary embodiment are explained.

Since the configuration described above is configured similarly to vehicle door lock device 10 according to the first exemplary embodiment in all respects other than the provision of neutral state recovery spring 202, similar effects to the first exemplary embodiment are also obtained by the configuration described above. Further, owing to the provision of neutral state recovery spring 202, in a case of an "electrical fault" at electrical operation unit 24, since it is possible to switch from an unlatched state to a latched state of latch 20A even without activating cancellation unit 26 and releasing the connection between release lever 26B and cancellation lever 26C, front door 14 can be put into a closed state from an open state. Accordingly, in a case of an electrical fault, it is sufficient to only repair electrical operation unit 24 at a time of making repairs, and there is no need to go to the trouble of resetting cancellation pin 26D. As a result of this, ease of repair maintenance can be improved.

It should be noted that in the first and second exemplary embodiments discussed above, the configuration is such that disengagement part 26A releases engagement of cancellation pin 26D with release side engagement hole part 26Bd; however, the configuration is not limited to this, and may be such that engagement with cancellation side engagement hole part 26Cc is released, or may even include both configurations. Further, the configuration is such that disengagement part 26A releases the connection between release lever 26B and cancellation lever 26C by pushing up cancellation pin 26D toward a substantial vehicle upper side; however, the configuration is not limited to this, and, as one example, may be such that the connection between release lever 26B and cancellation lever 26C is released by cancellation pin 26D being disconnected between release lever 26B and cancellation lever 26C, or some other configuration.

In addition, active lever 22B is configured such that disengagement part 26A is operated by operation of either of door inner handle 14E or key lever 22D; however, the configuration is not limited to this, and may be such that disengagement part 26A is operated by operation of door outer handle 14C, or such that disengagement part 26A is operated by operation of only one or other of door inner handle 14E or key lever 22D. Further, the configuration may be such that disengagement part 26A is operated by some other operative part.

Furthermore, vehicle door lock devices 10, 200 are configured to be provided at front door 14; however, the configuration is not limited to this, and may be such that vehicle door lock devices 10, 200 are provided at another door such as a rear door or a tailgate door.

Further, connection part 26Bg (see FIG. 7), which connects release side engagement hole part 26Bd with a vehicle front side of first through-hole 26Bc, is formed at a part of an outer edge part of release side engagement hole part 26Bd, and cancellation side engagement hole part 26Cc is engaged with cancellation pin 26D at a position corresponding to connection part 26Bg; however, the configuration is not limited to this, and may be such that release side engagement hole part 26Bd and cancellation side engagement hole part 26Cc are interchanged. That is, the configuration may be such that a connection part is provided at cancellation side engagement hole part 26Cc, and release side engagement hole part 26Bd engages with cancellation pin 26D at a position corresponding to this connection part.

The present disclosure is not limited to the above-described embodiments, and may, of course, be implemented in embodiments other than those described above according to various modifications that does not depart from a scope of the disclosure.

What is claimed is:

1. A vehicle door lock device, comprising:

a latch unit provided at a vehicle door, selectively adopting an unlatched state in which the vehicle door can be opened relative to a vehicle body, or a latched state in which the vehicle door is maintained in a closed state relative to the vehicle body, and transitioning from the unlatched state to the latched state in a case, in the unlatched state, in which the vehicle door is closed relative to the vehicle body;

a mechanical operation unit comprising a plurality of operative parts, switching the latch unit from the latched state to the unlatched state by means of at least one of the operative parts being operated;

an electrical operation unit connected to the mechanical operation unit, being provided with a drive unit, and switching the latch unit to the latched state or to the unlatched state, by means of power from the drive unit; and a cancellation unit that releases the connection between the electrical operation unit and the mechanical operation unit, wherein:

the latch unit comprises a release part that selectively adopts an engaged state of engagement with a latch, or a non-engaged state of non-engagement with the latch, the latch unit being in the latched state in the engaged state and the latch unit being in the unlatched state in the non-engaged state, the electrical operation unit comprises a wheel gear that is engaged with the drive unit and configured rotatably, and a lever member that is engaged with the wheel gear and that switches the release part between the engaged state and the non-engaged state by being displaced in conjunction with the rotation of the wheel gear, the cancellation unit comprises:

a cancellation lever that is engaged with the wheel gear and at which a cancellation side engagement hole part is formed, a release lever that switches the release part between the engaged state and the non-engaged state, and at which a release side engagement hole part is formed at a position corresponding to the cancellation side engagement hole part of the cancellation lever, and a cancellation pin that is inserted so as to engage with each of the cancellation side engagement hole part and the release side engagement hole part and that connects the cancellation lever with the release lever, the cancellation unit is disposed with a disengagement part that releases the cancellation pin from engagement with at least one of the cancellation side engagement hole part or the release side engagement hole part, and that releases the connection between the cancellation lever and the release lever, the mechanical operation unit comprises an active lever that switches between a locked state that restricts transition of the release part from the engaged state to the non-engaged state, and an unlocked state that permits transition of the release part from the engaged state to the non-engaged state, by means of operation of at least one of the plurality of operative parts, and the disengagement part of the cancellation unit is provided at the active lever.

2. The vehicle door lock device recited in claim 1, wherein:

the active lever moves in conjunction with at least one of a key lever provided at a vehicle width direction outer side of the vehicle door or an inside lever provided at a vehicle width direction inner side of the vehicle door; and the disengagement part of the active lever is configured to be operable such that the cancellation pin moves away from at least one of the cancellation side engagement hole part or the release side engagement hole part by means of operation of the key lever or the inside lever.

3. The vehicle door lock device recited in claim 1, wherein:

a connection part, which connects the release side engagement hole part with a vehicle front side of a through-hole formed at the release lever, is formed at a part of an outer edge part of the release side engagement hole part; and the cancellation side engagement hole part engages with the cancellation pin at a position corresponding to the connection part.

* * * * *